US005483322A

United States Patent [19]

Otome et al.

[11] Patent Number: 5,483,322

[45] Date of Patent: Jan. 9, 1996

[54] DEVELOPING UNIT FOR AN ELECTROPHOTOGRAPHIC APPARATUS

[75] Inventors: Yukio Otome; Kouji Doi; Youichi Takeuchi; Koutaro Yamada; Yoshio Ogura; Hiroshi Ueno, all of Ibaraki, Japan

[73] Assignee: Hitachi Koki Co., Ltd., Tokyo, Japan

[21] Appl. No.: 269,078

[22] Filed: Jun. 30, 1994

[30] Foreign Application Priority Data

Jun. 30, 1993 [JP] Japan ..... 5-162368

[51] Int. Cl.[6] ..... G03G 21/00

[52] U.S. Cl. ..... 355/215; 355/245; 355/260; 355/269; 355/270

[58] Field of Search ..... 118/652; 355/269, 355/270, 215, 245, 260, 305

[56] References Cited

U.S. PATENT DOCUMENTS

| | | | |
|---|---|---|---|
| 3,543,720 | 12/1970 | Drexler et al. | 118/652 |
| 3,739,749 | 6/1973 | Kangas et al. | 118/652 |
| 4,457,257 | 7/1984 | Murakami et al. | 118/652 |
| 5,138,382 | 8/1992 | Van Duser et al. | 355/215 |
| 5,151,739 | 9/1992 | Hediger | 355/245 |
| 5,177,533 | 1/1993 | Ishiguro et al. | 355/215 |
| 5,187,529 | 2/1993 | Nakayama | 355/245 X |
| 5,216,467 | 6/1993 | Esser et al. | 355/215 |
| 5,220,382 | 6/1993 | Hediger | 355/245 |
| 5,283,617 | 2/1994 | Benedict et al. | 355/215 X |
| 5,387,963 | 2/1995 | Kajimoto et al. | 355/215 X |

*Primary Examiner*—Matthew S. Smith

*Attorney, Agent, or Firm*—Sughrue, Mion, Zinn, Macpeak & Seas

[57] ABSTRACT

A developing unit for an electrophotographic apparatus comprises a photosensitive body for forming a latent image thereon, a developing roll utilizing two-component developer containing toner and carrier to develop the latent image formed on the photosensitive body, a recovery roll, provided downstream of the developing roll, for recovering carrier from a surface of the photosensitive body, and at least one recess formed in an inner surface of the developing unit which is confronted with an outer cylindrical surface of the recovery roll, in such a manner that air pressure formed in the recess prevents the developer from scattering out of the developing unit.

3 Claims, 2 Drawing Sheets

DEVELOPING UNIT FOR AN ELECTROPHOTOGRAPHIC APPARATUS

BACKGROUND OF THE INVENTION

1. Field of the Invention

This invention relates to a developing unit for an electrophotographic apparatus.

2. Discussion of the Related Art

In a developing unit using a two-component developer, sometimes carrier as well as toner sticks onto the surface of a photosensitive body in developing a latent image formed in the photosensitive body. In order to remove the carrier, the developing unit is provided with a recovery roll.

In an electrophotographic apparatus in which the carrier recovered with a recovery roll is returned to the developing unit, a gap is defined between the outer surface of the recovery roll and the inner surface of the developing unit, which is large enough for the recovered carrier to pass through. Hence, the developer may be scattered out of the developing unit through the gap. In order to overcome this difficulty, heretofore the gap is closed with a sealing member made of a polyester film or the like.

If, in the electrophotographic apparatus, toner stuck on the recovered carrier is caught between the recovery roll and the sealing member, then the toner is melted by the frictional heat produced by the rotation of the recovery roll, as a result of which the toner'grain size increases. If the toner with increased grain size is mixed with the developer at the developing unit, then it is used in the developing operation. In such a case, the resultant print is lowered in print quality.

SUMMARY OF THE INVENTION

Accordingly, an object of the invention is to provide a developing unit for an electro-photographic apparatus in which it is unnecessary to close the gap with a sealing member, which is formed between the outer surface of the recovery roll and the inner surface of the developing unit, and to improve the print quality in the electro-photographic apparatus.

The foregoing object of the invention has been achieved by the provision of a developing unit for an electrophotographic apparatus, in which, according to the invention, at least one recess is formed in the inner surface of the developing unit, which is confronted with the outer cylindrical surface of the recovery roll, in such a manner that air pressure formed in the recess prevents the developer from scattering out of the developing unit.

In the case of the developing unit thus designed, it is unnecessary to provide a sealing member to close the gap between the outer cylindrical surface of the recovery roll and the inner surface of the developing unit, and therefore the above-described difficulty accompanying a conventional developing unit namely, that the toner' grain size increases, is eliminated. Thus, with an electro-photographic apparatus designed in this manner, the picture quality of the resultant print is improved.

The above and further objects, features and advantages of the invention will appear more fully from the accompanying drawings and the following detailed description.

DETAILED DESCRIPTION OF THE PREFERRED EMBODIMENT

Figure 1:
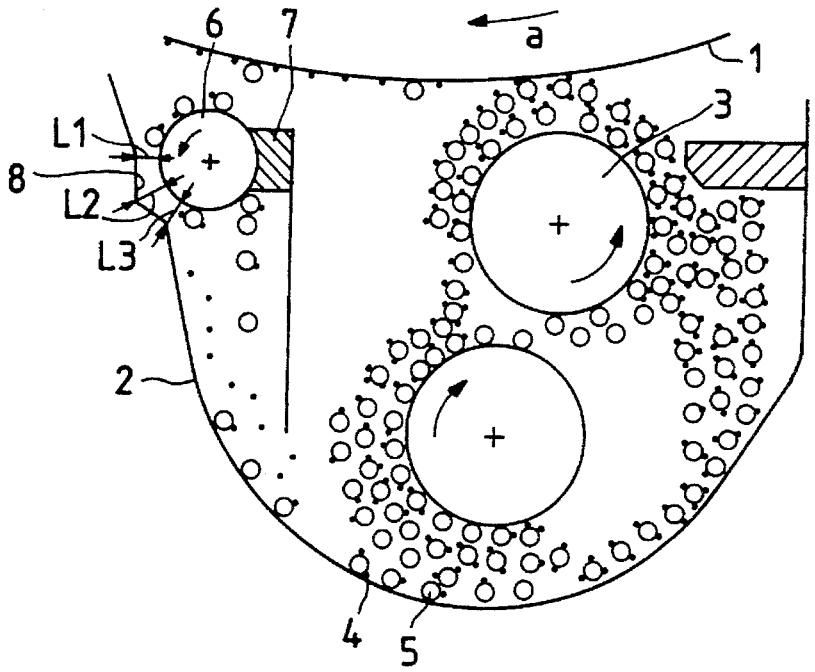
FIG. 1 is an explanatory diagram outlining the arrangement of a developing unit according to an embodiment of the invention.

One preferred embodiment of this invention will be described with reference to FIG. 1.

In the figure, reference numeral 1 designates a photosensitive body, which is rotated in the direction of the arrow "a". Before the photosensitive body 1 is subjected to a developing process, it is subjected to a latent image forming process to form a latent image thereon. When the portion of the photosensitive body where the latent image has been formed reaches a developing roll 3 provided in a developing unit 2, the latent image is developed into a visible image by a developer magnetic brush formed by the developing roll 3.

As is well known in the art, the developer magnetic brush is formed using a two-component developer containing toner 4 and carrier 5. In the case where carrier 5 together with toner 4 sticks on the surface of the photosensitive body 1, the carrier 5 is recovered by the magnetic action of a recovery roll 6 provided downstream the developing roll 3.

Carrier 5 stuck on the recovery roll 6 is scraped off by a scraping member 7 held abutted against the cylindrical surface of the recovery roll 6, and is thus returned into the developing unit 2.

Figure 2:
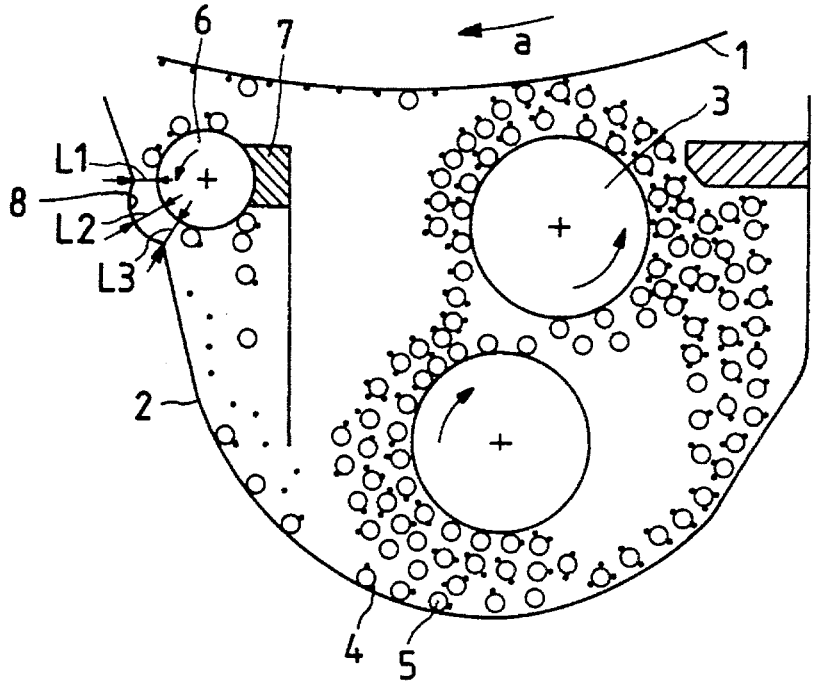
FIG. 2 is an explanatory diagram outlining the arrangement of a developing unit according to one modified embodiment of the invention.
Figure 3:
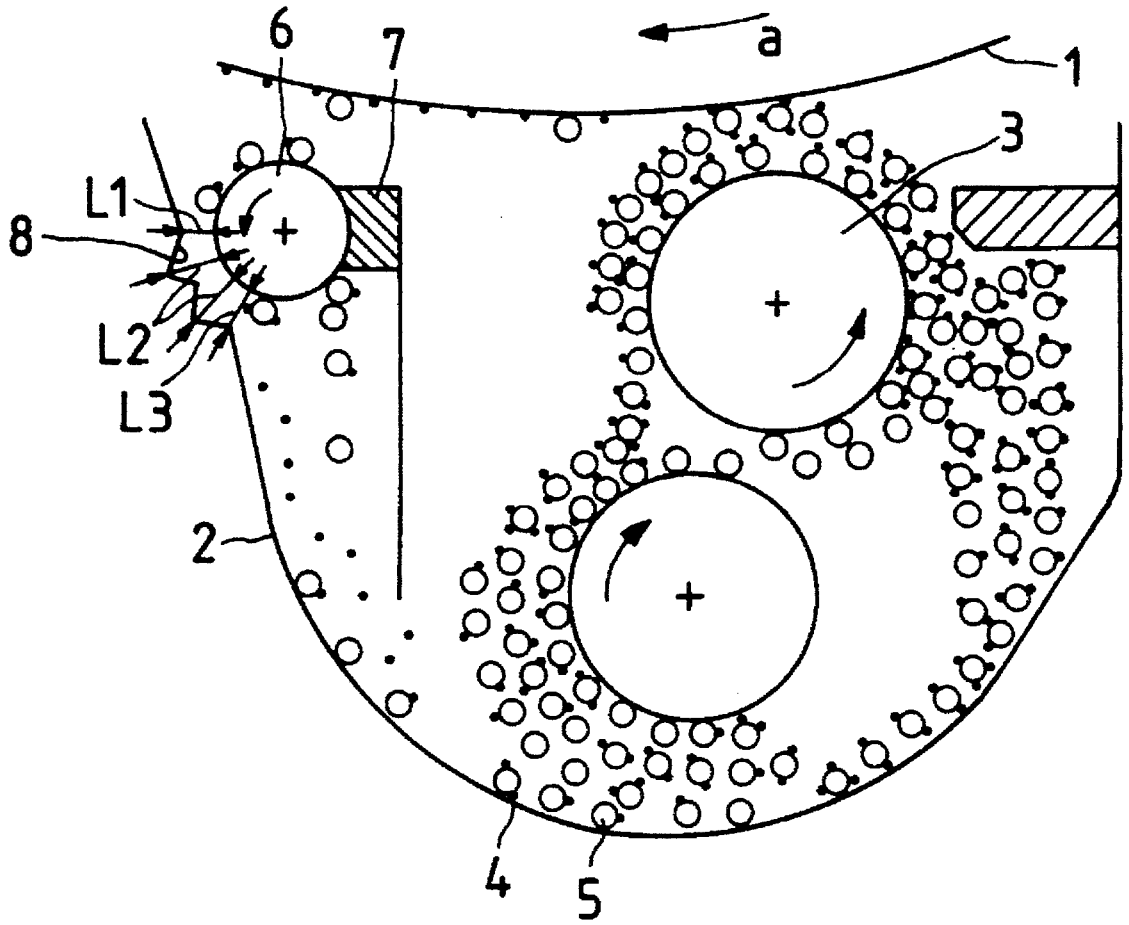
FIG. 3 is an explanatory diagram outlining the arrangement of a developing unit according to another modified embodiment of the invention.

A recess 8 is formed in the inner surface of the developing unit 2 which is confronted with the outer cylindrical surface of the recovery roll 6 in such a manner that there are gaps L1, L2 and L3 between the two surfaces as shown in FIGS. 1–3, which meet the condition L1<L2 and the condition L3<L2, so that the air pressure is decreased at the recess 8.

Hence, the air flows into the gap L2 from the exterior of the developing unit 2. Therefore, even when toner floating in the developing unit moves upwardly to flow out of the developing unit 2 through the space between the outer cylindrical surface of the recovery roll 6 and the inner surface of the developing unit 2, the scattering of the floating toner outside is prevented by the stream of air flowing from the exterior of the developing unit 2 into the gap L2.

When the recovery roll 6 is turned in the direction opposite to the direction of rotation of the photosensitive body 1, the action of the air stream, that is, the returning of the floating toner into the developing unit 2 is enhanced, so that the floating toner is even more effectively returned into the developing unit 2.

In the above-described embodiment, the recess 8 is a part of the inner surface of the developing unit 2; however, the invention is not limited thereto or thereby. For instance, a member having the recess 8 may be formed as an individual component, which is mounted on the inner surface of the developing unit 2. Furthermore, in the embodiment of FIG. 1, the recess 8 is in the form of an edge in section; however, it may a curved one as shown in FIG. 2. Still further, in the FIG. 1 embodiment, one recess 8 is provided, however, two or more recesses 8 may be provided as shown in FIG. 3.

As was described above, according to the invention, in the developing unit for an electrophotographic apparatus, which comprises: the developing roll which uses two-component developer containing toner and carrier to develop a latent image formed on the photosensitive body; and the recovery roll provided downstream of the developing roll, for recovering carrier from the surface of the photosensitive body, at least one recess is formed in the inner surface of the developing unit which is confronted with the outer cylindrical surface of the recovering roll, in such a manner that the air pressure formed in the recess prevents the developer from scattering out of the developing unit.

With the developing unit of the invention, it is unnecessary to provide a sealing member for closing the gap between the outer cylindrical surface of the recovery roll and the inner surface of the developing unit, and therefore the above-described difficulty accompanying the conventional developing unit whereby the grain size of the toner is increased, is eliminated. Thus, with the electrophotographic apparatus according to the invention, the resultant print is improved in picture quality.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A developing unit for an electrophotographic apparatus, comprising:

a photosensitive body for forming a latent image thereon;

a developing roll utilizing a two-component developer containing toner and carrier to develop the latent image formed on said photosensitive body;

a recovery roll provided downstream of said developing roll, for recovering carrier from a surface of said photosensitive body, said recovery roll being rotated in a direction opposite to a direction of rotation of said photosensitive body;

at least one recess formed in an inner surface of said developing unit which is confronted with an outer cylindrical surface of said recovery roll, in such a manner that air pressure formed in said recess prevents said developer from scattering out of said developing unit; and a scraping member abutting the outer cylindrical surface of said recovery roll at a location substantially opposite said recess.

2. A developing unit as claimed in claim 1, wherein said recess has an edge-shaped cross-section.

3. A developing unit as claimed in claim 1, wherein said recess has a curved cross-section.

* * * * *